United States Patent [19]

McClaren

[11] 4,242,806

[45] Jan. 6, 1981

[54] STACKED AIR DRYER WITH AIR RECIRCULATION

[76] Inventor: Jay L. McClaren, P.O. Box D, Dassel, Minn. 55325

[21] Appl. No.: 891,451

[22] Filed: Mar. 29, 1978

[51] Int. Cl.[3] ..... F26B 3/14

[52] U.S. Cl. ..... 34/13; 34/31; 34/65; 34/169; 34/174

[58] Field of Search ..... 34/13, 33, 34, 64–66, 34/82, 167–169, 174, 31; 432/96, 101, 78

[56] References Cited

U.S. PATENT DOCUMENTS

| | | | |
|---|---|---|---|
| 923,137 | 6/1909 | Cass | 34/65 |
| 2,437,899 | 3/1948 | Welty | 34/63 |
| 2,654,590 | 10/1953 | Molenaar | 34/65 |
| 2,740,204 | 4/1956 | Seltzer et al. | 34/174 |
| 2,764,819 | 10/1956 | Hallman | 34/169 |
| 3,237,315 | 3/1966 | Benecke | 34/65 |
| 3,325,912 | 6/1967 | Bojner et al. | 34/169 |
| 3,373,503 | 3/1968 | Kline et al. | 34/33 |
| 3,526,969 | 9/1970 | Alms et al. | 34/56 |
| 3,629,954 | 12/1971 | Lavalier | 34/174 |
| 3,727,323 | 4/1973 | Meiners et al. | 34/170 |
| 4,006,536 | 2/1977 | Meiners | 34/169 |
| 4,020,561 | 5/1977 | Mathews | 34/174 |
| 4,048,727 | 9/1977 | Botkins | 34/169 |
| 4,106,212 | 8/1978 | Batterton et al. | 34/174 |
| 4,125,945 | 11/1978 | Westelaken | 34/169 |

*Primary Examiner*—Larry I. Schwartz

*Attorney, Agent, or Firm*—H. Dale Palmatier

[57] ABSTRACT

A grain dryer having upright grain passages defined by perforate walls confining grain columns therein, the grain passages having offset portions and common inlets and outlets and vertically spaced plenum chambers, and a duct with a fan and burner drawing air from the lower plenum and applying the air in the upper plenum, a pair of upright imperforate plates lying along the exterior of the grain passages and directing a portion of the air emerging from the upper plenum to be recycled by again passing inwardly through the column and into the lower plenum.

18 Claims, 9 Drawing Figures

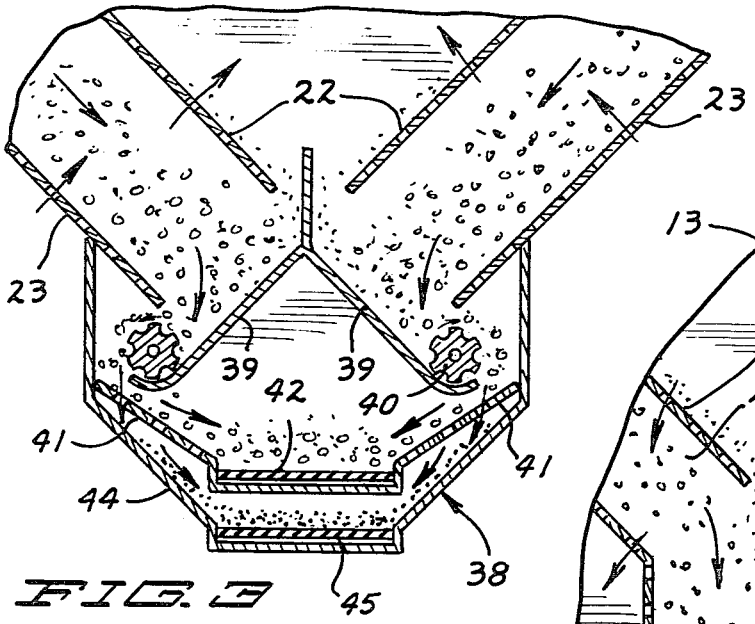
FIG. 3
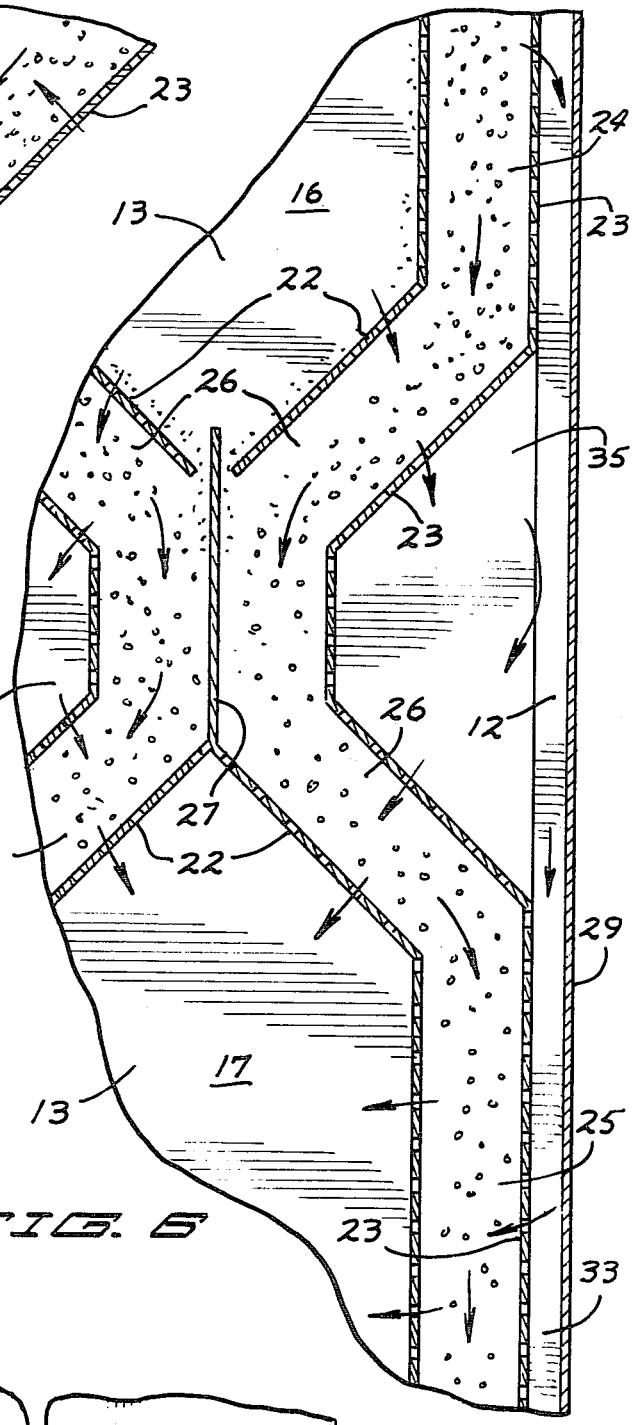
FIG. 6
FIG. 5
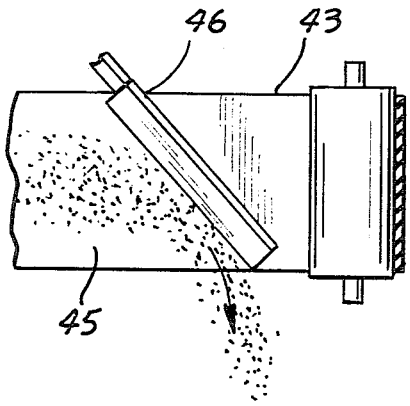
FIG. 4
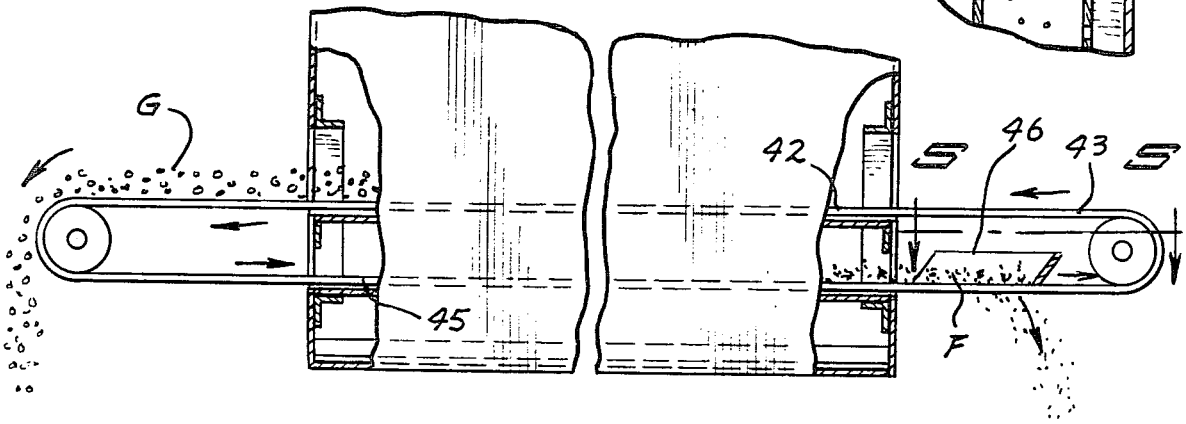

STACKED AIR DRYER WITH AIR RECIRCULATION

This invention relates to a grain dryer.

BACKGROUND OF THE INVENTION

Grain dryers have, for the most part, been fairly wasteful of heat, and the heated air is usually passed through the grain column only once. In some instances, such as in U.S. Pat. No. 4,020,561, the grain column is treated by air of progressively lower temperatures from a number of separate heaters in the drying column and then cooler air is drawn through the grain column for cooling the grain prior to discharge. The U.S. Pat. No. 3,526,969 shows a similar general arrangement wherein the column of grain is initially subjected to high temperatures for drying and then lower temperatures for cooling the heated grain.

There have been some instances of recirculating air in such structures as disclosed by U.S. Pat. No. 3,237,315, but in this structure, instead of using the hottest air to produce the initial and greatest degree of drying, the hot air which has been circulated twice through the grain column and cooled is again circulated through the wettest portion of the grain column with minimal effect. Further, this patent unnecessarily stresses the grain by suddenly applying the coldest air in the cooling process to the grain which has just prior been heated to the maximum extent by the hottest air in the grain dryer. Other grain dryers such as those described in U.S. Pat. Nos. 3,727,323 and 4,006,536, and 3,373,503, and 2,437,899, and 2,740, 204 show various air circulating patterns, none of which is very efficient from the standpoint of conservation of heat or fuel used to operate the burners in the heating units.

SUMMARY OF THE INVENTION

The present invention comprises a dryer wherein the grain is continuously moving down grain columns, is being continuously supplied at the top of the dryer and continuously drawn off at the bottom of the dryer in dried condition. Extremely efficient use of the drying air is made so that the necessary dryness is accomplished to prepare the grain for storage, and extremely efficient use is made of the air by recirculating the air at least three times through the grain.

In applicant's dryer, the hottest air is used to produce the maximum initial drying of the grain. Only the wettest of this hot air is released, and drier portions of this hottest initial air are recirculated through several drying fronts in the grain column. At least 40 percent of the heated air is recirculated.

After the initial drying of the grain and after extraction of the greatest proportion of the moisture from the grain, the grain is progressively cooled while drying continues. Fresh ambient air is moved only through the driest and coolest portions of the grain after the grain column has been traversed several times with heated, but partly cooled air.

The fines which often separate themselves from the grain are captured and conveyed out of the dryer in an orderly manner so that they may be utilized.

The dryer according to the present invention essentially stacks two dryers in superposed relation to each other so that efficient drying and cooling can be accomplished by passing the grain only once through the dryer. Every cubic foot of air is used in excess of three times in the drying process.

The grain undergoes at least three successive stages of drying and at least one cooling stage. If desired, multiple plenums may be located alongside the grain column to multiply the number of passes by the air through the grain column for heating and cooling.

The arrangement of the plenum chambers is such that an oil burner which requires an extremely long frame can be utilized in this dryer instead of necessarily relying upon propane gas.

BRIEF DESCRIPTION OF THE DRAWINGS

FIG. 3 is an enlarged detail section view of the continuous discharge portion of the dryer, and taken approximately at 3—3 in FIG. 1.

FIG. 4 is a detail elevation view, partly broken away and shown in section, of the lower discharge portion of the dryer.

FIG. 5 is a detail section view taken approximately at 5—5 in FIG. 4.

FIG. 8 is an elevation view of a second modified form of the invention.

DETAILED SPECIFICATION

Figure 2:
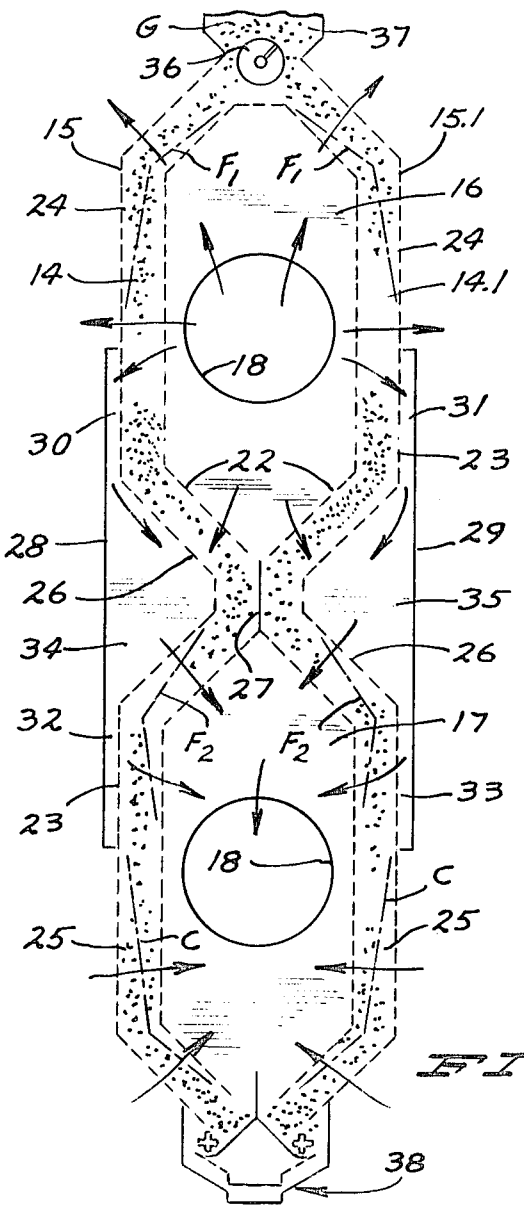
FIG. 2 is a diagrammatic vertical section view through the dryer and illustrating the mode of operation thereof.
Figure 1:
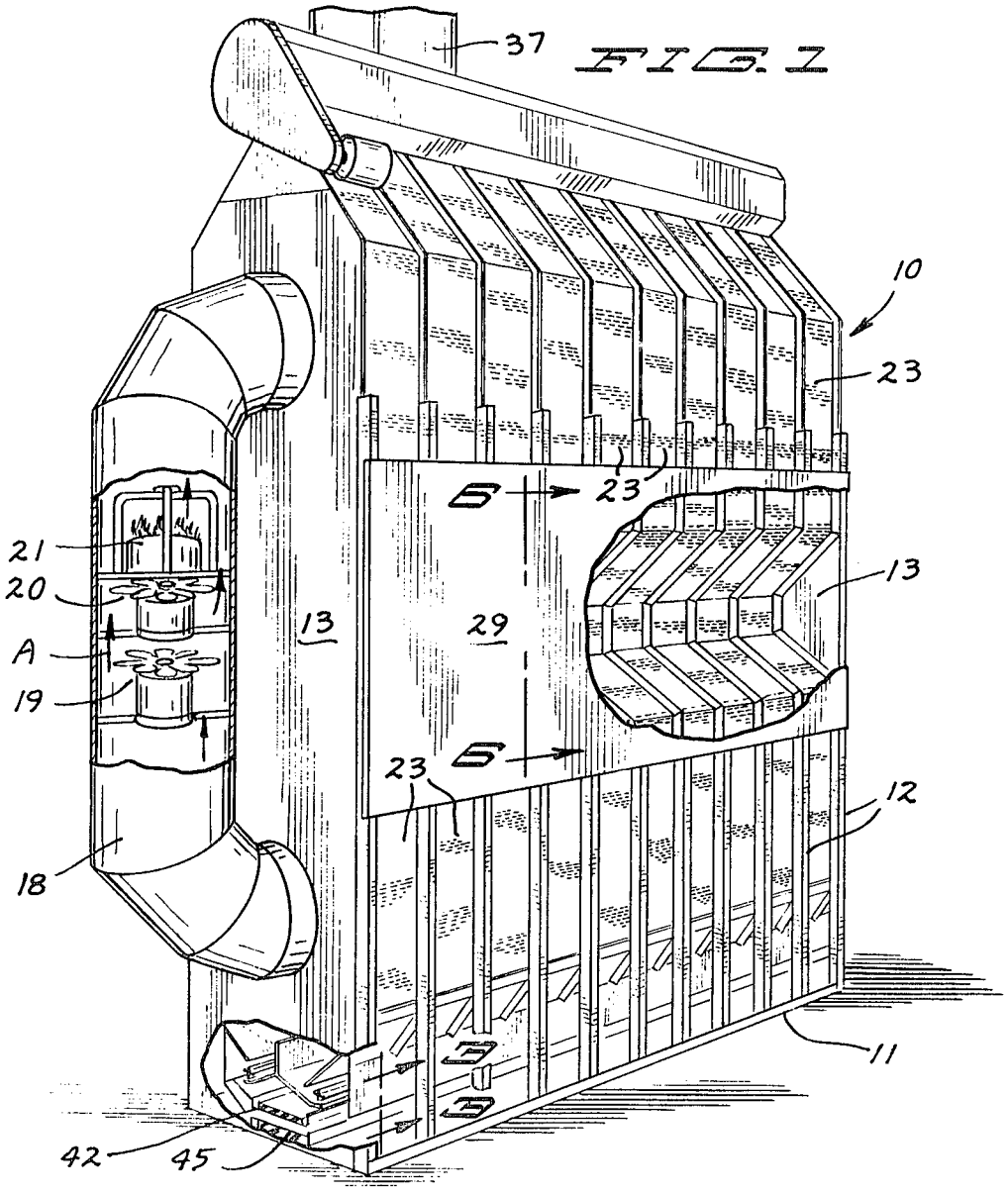
FIG. 1 is a perspective view of the dryer with portions thereof broken away for clarity of detail.
Figure 6:
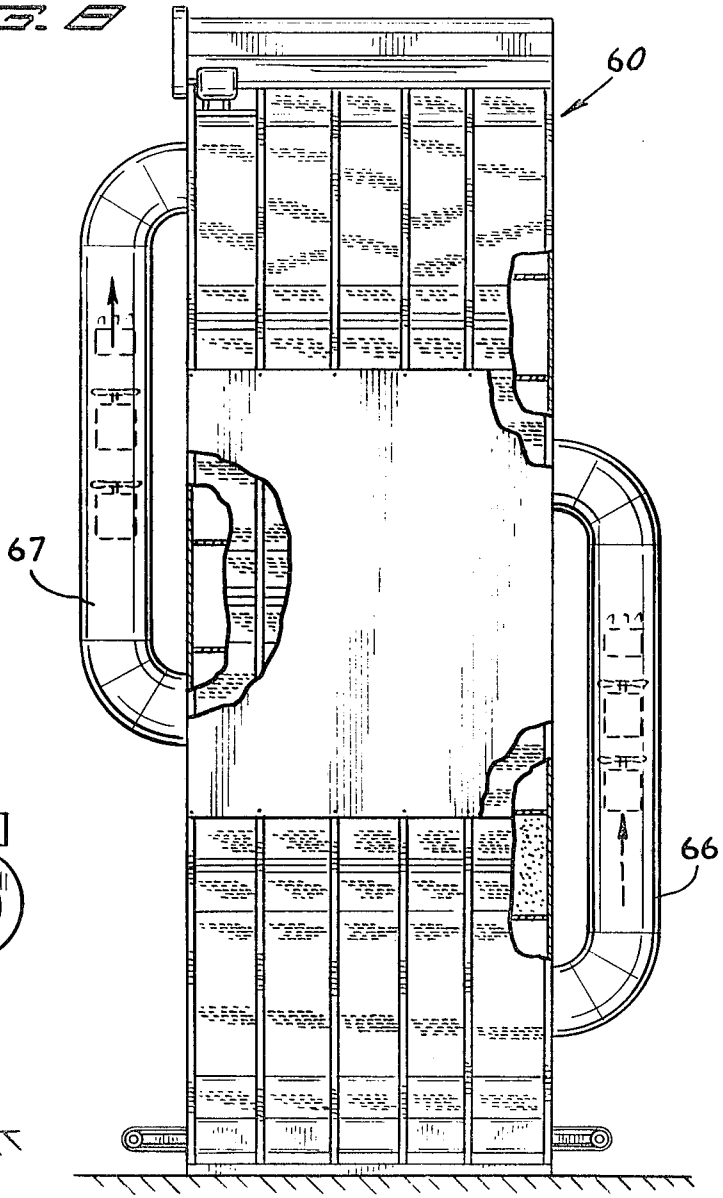
FIG. 6 is an enlarged detail section view taken approximately at 6—6 of FIG. 1.

The dryer illustrated in FIGS. 1–6 is indicated in general by numeral 10 and includes a frame 11 having upright frame elements 12 which support the structure of the dryer as a whole. End walls 13 are imperforate to confine air and grain in the grain columns 14 and 14.1. The dryer 10 defines two separate passages 15 and 15.1 through which the grain columns 14 and 14.1 continuously move downwardly. The passages 15 and 15.1 are substantially identical with each other, but are mirror images of each other and cooperate with each other to define upper and lower plenums 16 and 17, respectively. A duct 18 interconnects the lower plenum 17 with the upper plenum 16, and motor driven fans 19 and 20 which turn in opposite directions induce flow of air upwardly from the lower plenum 17 to the upper plenum 16 as is indicated by the arrows A. A burner 21 in the duct 18 heats the air as it flows upwardly into the upper plenum 16, and of course suitable thermostats and controls will regulate the burner 21 so that the air in the upper plenum 16 is heated to the proper degree. A typical operating temperature in the upper plenum may be in the range of 230° to 240° F.

The grain column passages 15 and 15.1 are formed by inner and outer perforate walls 22 and 23, respectively. The openings or perforations in the walls 22 and 23 are conventionally formed in narrow slits with small offset louvers allowing free flow of air transversely through the walls and grain column, but preventing any of the grain from escaping. It will be recognized that throughout most of the height of the dryer, the upright frame members 12 are disposed at the outer face of the outer perforate walls 23.

The passages 15 and 15.1 have upright and aligned upper and lower passage segments 24 and 25 and offset intermediate passage segments 26 which adjoin each other, but are maintained in physical isolation from each other by an imperforate panel 27 which forms a permanent divider between the two passages and the grain columns therein. Accordingly, none of the grain in either column will commingle with the grain in the other column. The upper portion of panel 27 is spaced slightly from the lower edge of the adjacent inner walls 22 as to allow grain dust to re-enter the grain column as the grain column moves downwardly.

A pair of imperforate sheet metal panels 28 and 29 span the offset intermediate segments of the passages, and extend upwardly and downwardly part way along the upright upper and lower segments 24 and 25 of the passages. Accordingly, the upper edges of the panels 28 and 29 are disposed opposite the upper plenum which carries superatmospheric pressurized air, and the lower edges of the panels 28 and 29 are disposed opposite the lower plenum 17 wherein the air is under a subatmospheric vacuum pressure.

The panels 28 and 29 lie on the upright frame members 12, and accordingly are maintained in spaced relation with the outer walls 23. As a result of this spaced relationship, air passages 30 and 31 are formed between the outer perforate walls 23 and the panels 28 and 29 to accommodate air flow in a downward direction. Similarly, air passages 32 and 33 are respectively formed between the outer sidewalls 23 and the panels 28 and 29 to accommodate air flow downwardly therein. The panels 28 and 29 also cooperate with the offset intermediate segments 26 of the passages 15 and 15.1 to define return air plenums 34 and 35 through which recycled air flows from the upper plenum 16 to the lower plenum 17.

The upper inlet ends of the two passages 15 and 15.1 merge together to receive grain from a common source which supplies the grain by means of a screw conveyor 36 supplied from a hopper or duct 37.

The bottom outlets of the passages 15 and 15.1 direct the grain toward a common discharge 38. At the outlet ends of the passages, the grain flows downwardly along inclined panels 39 and is propelled outwardly by splined or ribbed rotating rollers 40 whereupon the grain falls downwardly onto inclined perforate plates or screens 41 which guide the grain onto the upper run 42 of a belt conveyor 43. The fines or dust which fall through the perforate wall or screen 41 is directed downwardly by imperforate bottom walls 44 onto the bottom run 45 of the belt conveyor 43. These fines F are diverted off to the side by a scraper 46 adjacent one end of the conveyor. Accordingly, the grain G emerges from one end of the dryer as illustrated in FIG. 4, and the fines or dust F is discharged at the other end of the dryer.

In operation, grain is continuously supplied at the top inlet ends of the passages 15 and 15.1 by the screw conveyor 36, and grain is continuously discharged from the bottom outlet ends of the passages by conveyor 43. Accordingly, grain continuously moves down the passages 15 and 15.1.

The fans 19 and 20 continuously move the air upwardly through duct 18, creating a subatmospheric vacuum pressure in the plenum 17 and supplying superatmospheric pressurized and heated air into the upper plenum 16.

Accordingly, heated air flows outwardly from the upper plenum and through the adjacent upper segments 24 of the passages 15 and 15.1. At the uppermost portions of the passages 15 and 15.1, the heated air which passes through the grain column and the passages is discharged into the atmosphere. This grain in the uppermost portion of the passages is the coldest and wettest portion of all of the grain in the columns. The initial drying fronts $F_1$ gradually move toward the outer walls 23 as the grain column approaches the upper edges of the panels 28 and 29. The frying fronts $F_1$ are determined by a significant rise in temperature in the grain column and the location of the fronts is indicated by the dot-dash line in FIG. 2.

As the grain in the column passes downwardly along the upper edges of panels 28 and 29, heated air from the plenum 16 continues to flow through the grain columns, causing continued drying, and then into the air flow passages 30 and 31 and into the return air plenums 34 and 35.

The air which flows into the return air plenums 34 and 35 from the passages 30 and 31 and also from the offset intermediate segments 26 of the passages adjacent plenum 16, is warm air, but is not nearly as hot as the air found in plenum 16.

The air which has traversed the lower portion of upright segments 24 of the passage, and the air which traverses the offset segments 26 of the passages is again recycled or returned through the grain column again. This air from return air plenums 34 and 35 traverses the grain columns again and passes into the vacuum air plenum 17. Some of the air from plenums 34 and 35 moves downwardly in passages 32 and 33 and traverses the grain column along the lower upright segments 25 of the passages 15 and 15.1. As the air flows from plenums 34 and 35 through the grain column again, and into the lower plenum 17, second drying fronts $F_2$ are established so that additional drying of the grain occurs. Because a substantial amount of the heat has been removed from the air which is recycled through the plenums 34 and 35, the temperature of the grain is gradually tempered, but drying continues until the grain reaches a location opposite the lower edges of imperforate panels 28 and 29. The vacuum air pressure in plenum 17 not only draws the heated air being recycled from plenums 34 and 35, but also draws cool atmospheric air through the lower portions of upright segments 25 of the passages 15 and 15.1 so as to completely cool the grain in the column by the time the grain reaches the bottom outlets. The cooling is depicted by the cooling fronts C, and these are also detected by a marked drop in temperature of the columns as the columns pass downwardly toward the outlet.

It will be seen that the air which is recycled through return air plenums 34 and 35 into the lower vacuum air plenum 17 is commingled with the make-up air which is drawn from the atmosphere, and then this air is moved upwardly through duct 18 into the upper plenum again.

Significant quantities of the air in the dryer 10 are used and reused a number of times.

Only a portion of the air is discharged from the upper pressurized plenum 16 through the grain column and into the atmosphere. The remainder of the air is recycled and reused several times and is caused to traverse the grain columns twice as the air at the grain columns pass toward the bottom outlet.

Figure 7:
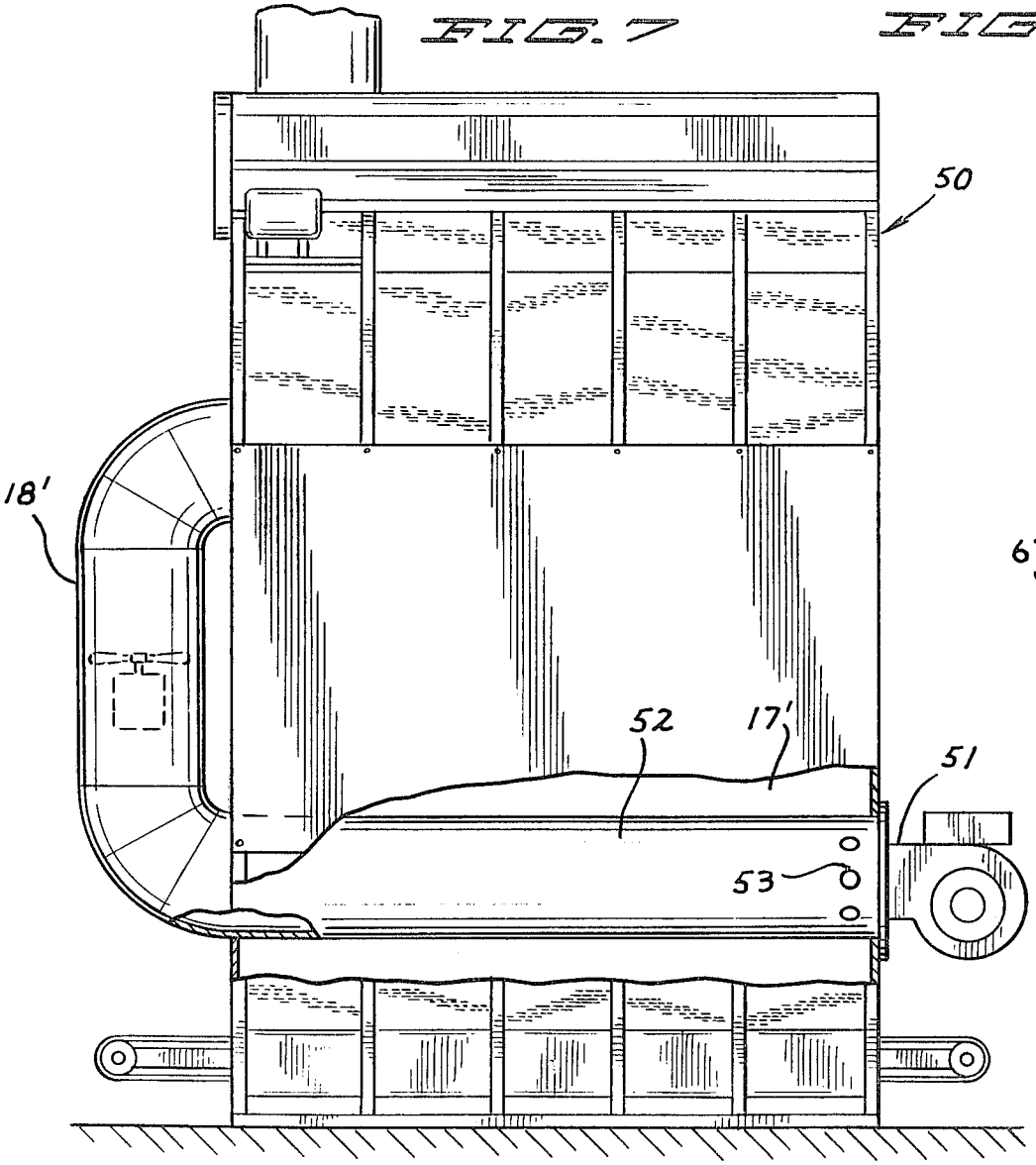
FIG. 7 is an elevation view of a modified form of the invention.

In the form of the invention illustrated in FIG. 7, the dryer 50 is substantially identical to that illustrated in FIGS. 1–6 excepting for the source of heat which is provided for the air being delivered through duct 18' into the upper plenum. In this form of the invention, an oil burner 51 supplies the necessary heat instead of the burner 21 in FIG. 1 which would typically burn propane gas. The oil burner 51 directs its flame into an elongate duct 52 which extends entirely the length of the lower plenum 17'. The nature of an oil burner is such that an elongate duct is required in order to obtain the complete combustion of the fuel and the present dryer accommodates itself very well to the use of an oil burner in this manner. Of course, the duct 52 has a number of openings to supply secondary air and to create the vacuum air pressure in the plenum 17.1 as required and as described in connection with FIGS. 1–6.

Figure 9:
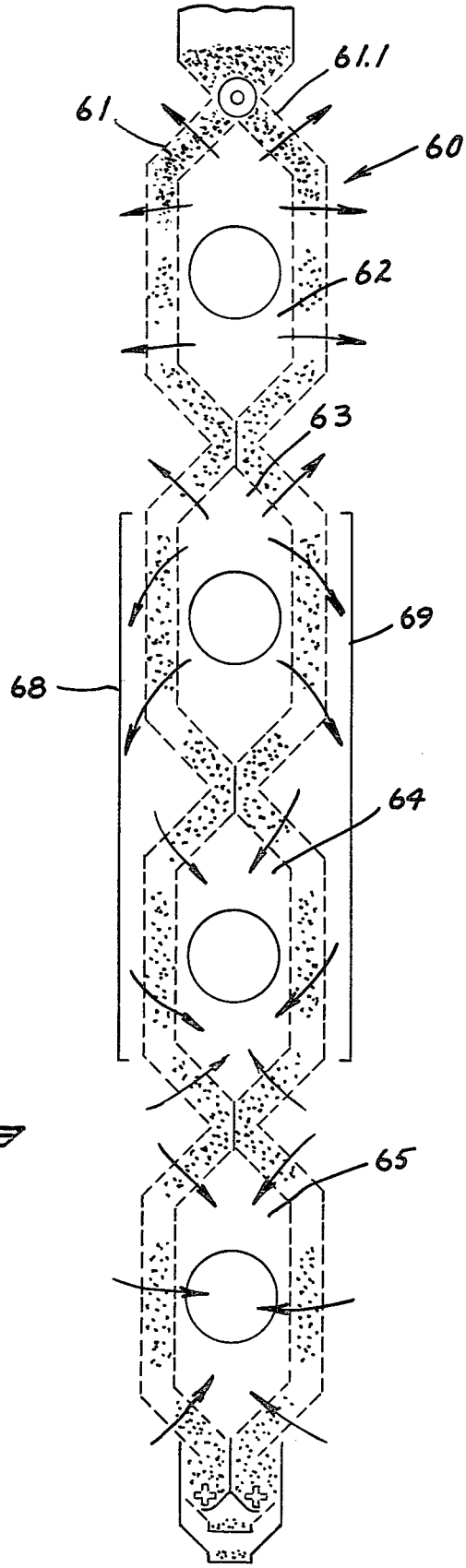
FIG. 9 is a diagrammatic vertical section view through the form of dryer illustrated in FIG. 8.

In the form illustrated in FIGS. 8 and 9, the stacked dryer 60 has the passages 61 and 61.1, which are similarly defined by perforate walls, arranged with numerous offset intermediate segments so as to define four different plenums 62, 63, 64 and 65 in superposed relation with each other. The lowermost plenum 65 is connected by duct 66 to plenum 63 so as to induce flow of air from plenum 65 into plenum 63 and to heat the air as the flow occurs.

The plenum 64 is connected by a duct 67 to the upper plenum 62 and has fans and a burner to induce the flow and heat the air as the flow occurs. The temperature in the uppermost duct 62 will be the hottest, preferably in the range of 230°–240° F. In the next lower plenum 63, the temperature of the air may be typically in the range of 200°–220° F. In the two lower plenums, the temperature is progressively lower as cool atmospheric air is drawn into these plenums from the atmosphere. It will be recognized that the air in the upper two plenums 62 and 63 is superatmospheric pressurized air, and the air in the lower two plenums 64 and 65 is subatmospheric vacuum air.

The panels 68 and 69 span the passages and are arranged with their upper edges opposite the pressurized plenum 63, and with their lower edges opposite the vacuum air plenum 64.

In this arrangement of dryer 60, the dryer will have substantially greater capacity than the two stage dryer according to FIGS. 1–6 and the air is recirculated in a similar manner. Approximately 40 percent of the air is recirculated, as is the case in the dryer 10; and approximately 60 percent of the air in dryer 60 is exhausted to the atmosphere, as is the case in dryer 10.

In this form of the invention, all of the pressurized air from plenum 62 traverses the grain columns and is exhausted to the atmosphere. From pressurized plenum 63, a small portion of the heated air is discharged to the atmosphere, but a very major portion of the air from plenum 63 is recirculated downwardly along the panels 68 and 69 as to traverse the grain columns again and pass into the vacuum air pressure plenum 64. Plenum 64 also draws a small proportion of the air direct from the atmosphere to commence the cooling of the grain . Vacuum air pressure in plenum 65 draws all of the air into plenum 65 from the atmosphere and causes cooling of the grain columns as the air traverses the column. It will be recognized that the cool air is initially heated as the air traverses the grain columns and moves into plenum 65, and then the air is significantly heated as the air is directed through duct 66 and into plenum 63. From plenum 63 the air is recirculated to a large degree into plenum 64 whereupon the vacuum air therein is drawn upwardly through duct 67 and is heated again as the air is delivered to the duct 62.

Accordingly, there is significant recycling of the heated air as to extract the utmost drying capacity from the air and as to temper the grain prior to the application of the cool air from the atmosphere into the grain columns.

It will be seen that I have provided a new and improved stacked dryer wherein the heated air is used and reused a number of times so as to obtain maximum drying from the air and as to temper the air to moderate the temperatures before cool atmospheric air is applied for the final cooling prior to discharge.

What is claimed is:

1. A grain dryer comprising an upright grain column passage means having a top inlet and a bottom outlet, the passage means having upright and aligned top and bottom passage segments and a pair of intermediate passage segments therebetween, said passage means having opposite obverse and reverse sides defined by perforate walls confining the grain column therebetween and passing air therethrough and into and through the grain column, enclosure means at the reverse side of the full length of the passage means and engaging the passage means adjacent the inlet and outlet and intermediate segments to define enclosed upper and lower plenums respectively adjacent the top, bottom and intermediate passage segments, air treating means heating and inducing flow of air in a duct from the lower plenum to the upper plenum for producing flow of heated drying air outwardly through the grain column in said top passage segment and in the adjacent intermediate passage segment to produce drying thereof, a portion of the air supplied from the lower plenum being drawn from the atmosphere and through the grain column at the bottom passage segment for cooling the grain, an upright panel confronting the obverse side of the passage means adjacent said intermediate passage segments, the panel also extending upwardly and downwardly partly along the top and bottom passage segments, and the intermediate passage segments of the passage means being obliquely offset with respect to the top and bottom passage segments and with respect to each other and being spaced from the panel to cooperate with the panel in defining a return air plenum receiving drying air from the upper plenum and from the adjacent grain column and passage means wherein drying of the grain column is effected, and returning the air to the lower plenum and through the adjacent grain column and passage means to effect additional drying of the grain column.

2. The grain dryer according to claim 1 and said upright panel being spaced from the perforate walls to permit drying air to pass transversely through the grain column and passage means adjacent the panel.

3. The grain dryer according to claim 1 and said upright panel extending to approximately midway of the height of said top and bottom passage segments of the passage means and in spaced relation with the perforate wall thereof.

4. The grain dryer according to claim 1 and said enclosure means comprising a second upright grain column passage means substantially identical with said first mentioned upright grain column passage means, and a second upright panel confronting the obverse side of the second passage means and adjacent the intermediate passage segments thereof, the second upright panel also extending upwardly and downwardly partly along the top and bottom passage of said second passage means.

5. The grain dryer according to claim 4 and the first mentioned and second passage means abutting each other at said intermediate passage segments and an upright imperforate panel separating said first mentioned and second passage means adjacent the obliquely offset intermediate passage segments of the passage means.

6. A grain dryer comprising an upright grain column passage means having a top inlet and a bottom inlet, the passage means having top, intermediate and bottom passage segments in open communication with each other for free passage of the grain column downwardly therealong, said passage means having opposite obverse and reverse sides defined by perforate walls confining the grain column therebetween and passing air therethrough and into and through the grain column, enclosure means at the reverse side of the full length of the passage means and engaging the passage means adjacent the inlet and outlet and at the intermediate segment to define enclosed upper and lower plenums respectively adjacent the top and bottom passage segments, air treating means heating and inducing flow of air in a duct from the lower plenum to the upper plenum, a panel confronting the obverse side of the passage means, the panel traversing the intermediate passage segment, and the panel being spaced outwardly from the intermediate passage segment as to define a return air plenum receiving drying air from the upper plenum and through the adjacent grain column and passage means, and returning the drying air to the lower plenum and through the adjacent grain column and passage means for additional drying.

7. The grain dryer according to claim 6, and the top and bottom passage segments respectively extending upwardly and downwardly beyond said panel to permit flow of air through the top and bottom segments without passing through said return air plenum.

8. The grain dryer according to claim 6, and said enclosure means comprising a second upright grain column passage means substantially identical with said first mentioned upright grain column passage means, the reverse sides of said first mentioned and second passage means confronting each other adjacent said upper and lower plenums, and a second panel confronting the obverse side of the second passage means and being spaced outwardly from the intermediate passage segment thereof to define a return air plenum.

9. A grain dryer, comprising an upright grain column passage means having a top inlet and a bottom outlet and having obverse and reverse sides defined by perforate walls confining the grain column therebetween and passing air therethrough and into and through the grain column, enclosure means extending along the full length of the reverse side of the passage means and cooperating with the passage means in defining a plurality of upper and lower plenums in superposed relation with each other and at the reverse side of the passage means, air treating and delivery means establishing heated and superatmospheric pressurized air and also establishing subatmospheric vacuum air in respective upper and lower plenums and causing flow of air through the grain column adjacent both plenums, and an imperforate panel confronting the obverse side of the passage means and in spaced relation therewith, the panel having upper and lower edges respectively disposed opposite plenums with pressurized air and vacuum air, the panel confining heated drying air emerging through the passage means and thereby supplying the heated drying air to be recycled through the passage means to produce additional drying, and the passage means having unobstructed segments above and below the panel and freely passing air therethrough for drying and cooling respectively.

10. The grain dryer according to claim 9 wherein the enclosure means and passage means define two such plenums.

11. The grain dryer according to claim 9 wherein said enclosure means and passage means define four such plenums.

12. The grain dryer according to claim 9 and said enclosure means and passage means cooperatively defining separation means maintaining the adjacent plenums in substantial isolation with respect to each other, the passage means and panel diverging with respect to each other adjacent said separation means and defining a return air plenum receiving air from the upper plenum and the adjacent grain column and passage means, and returning the air to the lower plenum and through the adjacent grain column and passage means.

13. The grain dryer according to claim 11 wherein the two uppermost plenums contain heated pressurized air and the two lower plenums contain vacuum air.

14. The grain dryer according to claim 13 wherein the air treating and delivery means withdraws air from the lowermost of the two vacuum air-containing plenums and delivers the air therefrom to the lowermost of the two pressurized air-containing plenums; and the air treating and delivery means also withdrawing air from the uppermost of the vacuum air-containing plenums and delivers said air to the uppermost of the pressurized air-containing plenums.

15. The grain dryer according to claim 9 and including an elongate duct extending substantially entirely horizontally through the lower plenum and in spaced relation with the passage means and having an air inlet from said lower plenum, and an oil burner connected with said duct supplying heat into the air drawn from the lower plenum.

16. A grain dryer comprising, a pair of upright grain column passage means having top inlets and bottom outlets, each of the passage means having upright and aligned top and bottom passage segments respectively adjacent the inlets and outlets, and both of the passage means having offset intermediate passage segments between said top and bottom passage segments, the intermediate passage segments of the passage means adjoining each other, both of said passage means having opposite obverse and reverse sides defined by perforate walls confining the grain column therebetween and passing air therethrough and into and through the grain column, the pair of passage means cooperatively defining upper and lower plenums respectively adjacent the top and bottom passage segments, air ducts interconnecting said upper and lower plenums and carrying fan means inducing flow of air from the lower plenum to the upper plenum and establishing superatmospheric pressure in the upper plenum and subatmospheric pressure in the lower plenum, and a pair of upright imperforate panels confronting the obverse sides of the passage means and spanning across said offset intermediate passage segments, said panels also extending upwardly and downwardly partly along the top and bottom passage segments of the passage means, the panels being spaced outwardly from the perforate walls of the top and bottom passage segments to cooperate therewith in defining flow passages for heated air emerging through the passage means and grain columns adjacent the upper plenum and being recycled through the passage means and grain column again into the lower plenum, and the panels cooperating with said intermediate passage segments of the passage means in defining return air plenums through which the recycled air passes.

17. The grain dryer according to claim 6 and the panel having upper and lower portions closely related to the adjacent passage means to minimize loss of air from the return air plenum.

18. A method of drying grain consisting in the steps of, continuously moving grain downwardly in a column of substantially uniform thickness, the column having an upper section, upper and lower intermediate sections, and a lowermost section, passing cool make-up air from the atmosphere through the lowermost section of the grain column, collecting the make-up air after passing through the grain column and adding heat to the collected air, passing a first portion of the heated collected air through the top section of the grain column and exhausting said first portion to the atmosphere, passing a second portion of the heated collected air through an upper intermediate section of the grain column, collecting said second portion of air after passing through the grain column, passing the collected second portion of air without temperature change through the lower intermediate section of the grain column and thereafter commingling such second portion of the air with the make-up air during said collecting of the make-up air.

* * * * *